United States Patent [19]

Winters

[11] 3,955,030

[45] May 4, 1976

[54] SURFACE COVERING MATERIAL HAVING IMPROVED DIMENSIONAL STABILITY

[75] Inventor: Donald C. Winters, Plainfield, N.J.

[73] Assignee: Congoleum Industries, Inc., Kearny, N.J.

[22] Filed: Oct. 2, 1972

[21] Appl. No.: 294,282

Related U.S. Application Data

[63] Continuation-in-part of Ser. No. 13,154, Feb. 20, 1970, abandoned.

[52] U.S. Cl. ..... 428/280; 156/62.2; 162/155; 428/290; 428/443; 428/502; 260/29.4 UA

[51] Int. Cl.[2] ..... B26B 19/02

[58] Field of Search ..... 260/29.4 UA, 852, 856, 260/851, 846; 161/242, 243, 205, 82; 117/126 AB, 126 AD

[56] References Cited

UNITED STATES PATENTS

| | | | |
|---|---|---|---|
| 2,624,682 | 1/1953 | Hazeltine | 260/852 |
| 2,880,090 | 3/1959 | Feigley | 117/126 |
| 3,141,809 | 7/1964 | Di Maio et al. | 161/205 |
| 3,188,233 | 6/1965 | Powers et al. | 260/852 |
| 3,212,955 | 10/1965 | Kaizerman | 161/243 |
| 3,240,658 | 3/1966 | Tucker et al. | 117/126 AB |
| 3,361,617 | 1/1968 | Kaizerman | 260/852 |
| 3,405,079 | 10/1968 | Huang et al. | 260/852 |
| 3,553,115 | 1/1971 | Curchod et al. | 260/852 |
| 3,666,400 | 5/1972 | Lofton et al. | 260/852 |
| 3,746,669 | 7/1973 | Dunnom et al. | 260/846 |

*Primary Examiner*—George F. Lesmes
*Assistant Examiner*—R. J. Roche
*Attorney, Agent, or Firm*—Richard T. Laughlin

[57] ABSTRACT

A surface covering material comprising a layer of felted asbestos fibers, a binder-impregnant for the asbestos fiber layer, a plasticized resinous wear layer applied to said asbestos fiber layer, the binder-impregnant for the asbestos fiber layer comprising a mixture of a synthetic rubber latex and a reactive resin. The product has improved dimensional stability and increased resistance to the effects of plasticizers on the asbestos fiber layer.

13 Claims, No Drawings

SURFACE COVERING MATERIAL HAVING IMPROVED DIMENSIONAL STABILITY

This is a continuation-in-part application of my copending application Ser. No. 13,154, filed Feb. 20, 1970, now abandoned.

This invention relates to a surface covering material and a method for producing the same, and refers more particularly to a surface covering material having improved dimensional stability by virtue of an improved asbestos backing layer to which a resinous wear layer is applied.

Sheets of resinous compositions have found wide spread use as decorative and wear resistant coverings for a wide range of products. Such sheets for example, are used extensively as wall, floor and table coverings, book covers, fabrics for use as upholstery and the like. In many cases, the resinous composition sheets are applied or formed on backing sheets such as woven fabrics, paper, felt and the like. These backing materials have many purposes, the most common of which is added strength and serviceability of the finished product.

Many types of decorative treatments are available for increasing the esthetic appeal of this type of product, and all of these finishing or decorating techniques require certain processing steps generally carried out under conditions of elevated temperature and sometimes elevated pressure.

One of the problems encountered in producing a product of the aforementioned type is that during the processing, when the resinous wear layer is applied as by lamination or coating techniques to the backing sheet, particularly in the case of asbestos backing sheets, the backing sheet tends to soften or stretch, particularly so under the influence of heat. Although the reason for this softening is not completely understood, it is believed to be due to the migration of the plasticizer from the resinous wear layer into the felt. The presence of the plasticizer in the felt has a deleterious effect upon the binder used in the felted asbestos fiber layer, and tends to soften the binder and thus reduce the dimensional stability of the asbestos layer. This effect has been particularly noted in the case of ester-type plasticizers which are commonly used in the wear layer composition. Typical of this type of plasticizer are dibutyl sebacate, dioctyl sebacate, dioctyl adipate, didecyl adipate, dioctyl azelate, triethylene glycol di(2-ethyl hexanoate), diethylene glycol dipelargonate, triethylene glycol dicaprylate, 2,2,4-trimethyl-1,3-pentanediol diisobutyrate, dibutyl phthalate, dicapryl phthalate, dioctyl phthalate, dibutoxy ethyl phthalate, dipropylene glycol dibenzoate, butyl benzyl sebacate, butyl benzyl phthalate, dibenzyl sebacate, dibenzyl phthalate and the like.

Under the influence of this type of plasticizers, the backing sheets tend to have a reduced tensile strength and greater elongation, as well as reduced rigidity. Where decorating or finishing techniques are applied to the product, frequently a plurality of printing stages is employed for printing various designs in different color inks in register. If the backing sheet stretches, obviously, this will result in applied decorations which are not in register. Thus, costly controls are required in the apparatus to reduce the off setting or mis-register of the decorative applications.

One attempt of overcoming the disadvantages caused by plasticizer migration is taught in U.S. Pat. No. 3,075,863, issued to H. E. Frey on Jan. 29, 1963. Here, the patentee interposed a "barrier layer" of polymethyl methacrylate between the base layer and the wear layer. Although this type of product would tend to reduce the migration of the plasticizer into the backing layer, increased cost is encountered in making this type of product in that it requires an additional laminating or coating step.

Therefore, a primary object of this invention is to provide a surface covering material which overcomes the disadvantages of prior art surface coverings.

A further object of this invention is to provide a surface covering having an improved backing sheet.

Another object of this invenion is to provide a surface covering having a backing sheet with improved dimensional stability.

Still a further object of this invention is to provide a surface covering having a backing sheet which does not soften under processing conditions.

Still another object of this invention is to provide a method for manufacturing an improved surface covering material.

Yet a further object of this invention is to provide a surface covering material of the vinyl-asbestos type which includes an improved fibrous backing layer.

Still another object of this invention is to provide a surface covering material having a synthetic resin wear layer and an asbestos fiber backing layer having a synthetic rubber latex and reactive resin binder.

These and other objects and advantages of this invention will become apparent when considered in light of the following description and claims.

DESCRIPTION OF THE INVENTION

It has now been found that the backing sheet used in surface coverings according to this invention may be improved by the addition of a reactive resin of the melamine or ureaformaldehyde type. The backing sheet is usually formed from a fibrous slurry which is laid onto a wire or the like for forming the sheet and drying the fibers into a felted, fibrous sheet. The apparatus used is conventional and may be a fourdrinier machine or a cylinder machine. The latex binder system is added to the fibers while the fibers are in the aqueous slurry.

In the preferred embodiment, the reactive resin is mixed with the latex binder, and the resin and latex mixture is added to the slurry at about 22–37% by weight of the slurry on a dry solids bases. Subsequently, the slurry is introduced into the sheet forming the apparatus.

Alternatively, the reactive resin may be added to the slurry first, and then the rubber latex may be added to the slurry. However, it has been found that if the latex is added first to the slurry, the reactive resin will not sufficiently coat the fibers and will not produce the improved results of the preferred embodiment. Additionally, by mixing the reactive resin and latex together before addition of the binder system to the slurry, only a single deposition step is required.

The latex binder utilized in the practice of this invention is a synthetic rubber latex, commonly referred to as an SBR latex. These are styrene-butadiene latexes.

The melamine or urea-formaldehyde type of reactive resin is utilized in the range of about 2 to about 20% by weight of the slurry solids (i.e. on a dry basis). Among the reactive resins which could be used in this invention and which have been found particularly suitable are:

hexamethoxymethylmelamine; 1-hydroxymethyl-3,5-dimethyoxymethylmelamine; N,N'-dimethylol-urea; dihydroxymethylolethylene urea; N,N'-bis(methoxymethyl) urea; N,N'-dimethylolpropylene urea; 5,5-dimethyl-N,N'-dimethylol propylene urea; N,N'-dimethylolethylene urea; and methylated methylolmelamine.

The wear layer utilized in the product of this invention may be a polymerized vinyl halide resin, such as vinyl bromide, or vinyl fluoride, and with vinyl chloride being particularly preferred. Additionally, polymers of vinyl acetate, vinyl chloroacetate, vinyl butyrate, other fatty acid vinyl esters, polymerized acrylic acid, polymerized alkyl esters of acrylic acid or methacrylic acid such as ethylacrylate, methylmethacrylate, ethylmethacrylate, ethylchloromethacrylate, and the like may be used.

The plasticizer for the wear layer is preferably the ester-type plasticizer as previously set out, since this type of plasticizer has been found to produce particularly good properties in the wear layer. Additionally, this type of plasticizer may be added to the rubber latex-reactive resin binder system for producing a product having good flexibility characteristics and still retaining good dimensional stability. If a plasticizer is utilized in the binder system, it should be added to the slurry simultaneously with the latex-reactive resin.

Additionally, it has been found that the incorporation of a minor amount of micro crystalline wax is advantageous in the binder system.

In practicing the process of this invention, the asbestos fibers, which are preferably crysotile, are slurried with water at about 3 to 7% consistency. The slurry is then pumped into a continuous precipitation equipment, where the binder system is added. The continuous precipitation is preferred, however, clearly, a batch system could also be used. An even deposition of the latex-reactive resin binder system onto the asbestos fibers is accomplished without the necessity of coagulation or precipitation agents. After the binder is deposited onto the asbestos fibers, the slurry is then fed to the paper making machinery where the fibers and binder are formed into sheets. The sheets are then dried and cured at approximately 390°F for about 2 minutes. The exact time and temperature for curing is of course dependent upon the exact quantity of latex and reactive resin in the binder as well as the amount of binder added to the slurry.

The following non-limiting examples are typical of slurry compositions utilized in this invention:

| Example I | Parts |
|---|---|
| Asbestos fibers, crysotile | 210 |
| Dow SBR Latex[1] SD 395 (48% solids by weight) | 71 |
| GAF SBR Latex[2] SP 100-66A (50% solids) | 20 |
| Microcrystalline Wax (50% solids) | 11 |
| Methylated Methylol Melamine Resin (65% solids) | 77 |
| Asbestos slurried at 3% consistency. | |

| Example II | Parts |
|---|---|
| Asbestos fibers, crysotile | 210 |
| Dow SBR Latex[1] SD 395 (48% solids by weight) | 71 |
| GAF SBR Latex[2] SP 100-66A (50% solids) | 20 |

-continued

| Example II | Parts |
|---|---|
| Microcrystalline Wax (50% solids) | 11 |
| Hexamethoxymethylmelamine (98% solids) | 51 |
| Asbestos slurried at 3% consistency. | |

| Example III | Parts |
|---|---|
| Asbestos fibers, crysotile | 210 |
| Dow SBR Latex[1] SD 395 (48% solids by weight) | 71 |
| GAF SBR Latex[2] SP 100-66A (50% solids) | 20 |
| Microcrystalline Wax (50% solids) | 11 |
| UF Resin[3] (55% solids) | 18.3 |
| Methylated Methylol Melamine (65% solids) | 61.6 |
| Asbestos slurried at 3% consistency. | |

| Example IV | Parts |
|---|---|
| Asbestos fibers, crysotile | 210 |
| Dow SBR Latex[1] SD 395 (48% solids by weight) | 71 |
| GAF SBR Latex[2] SP100-66A (50% solids) | 20 |
| Microcrystalline Wax (50% solids) | 11 |
| Methylated Methylol Melamine Resin (65% solids) | 38.5 |
| Asbestos slurried at 3% consistency. | |

| Example V | Parts |
|---|---|
| Asbestos fibers, crysotile | 210 |
| Dow SBR Latex[1] SD 395 (48% solids by weight) | 71 |
| GAF SBR Latex[2] SP 100-66A (50% solids) | 20 |
| Microcrystalline Wax (50% solids) | 11 |
| UF Resin[3] (55% solids) | 19.1 |
| Asbestos slurried at 3% consistency. | |

| Example VI | Parts |
|---|---|
| Asbestos fibers, crysotile | 210 |
| Dow SBR Latex[1] SD 395 (48% solids by weight) | 71 |
| GAF SBR Latex[2] SP 100-66A (50% solids) | 20 |
| Microcrystalline Wax (50% solids) | 11 |
| Methylated Methylol Melamine (65% solids) | 115.5 |
| Asbestos slurried at 3% consistency. | |

| Example VII (Control Example) | Parts |
|---|---|
| Asbestos fibers, crysotile | 210 |
| Dow SBR Latex[1] SD 395 (48% solids by weight) | 71 |
| GAF SBR Latex[2] SP 100-66A (50% solids) | 20 |
| Microcrystalline Wax (50% solids) | 11 |

[1]Butadiene-styrene
[2]Butadiene-styrene
[3]Urea formaldehyde

The foregoing slurries were introduced into hand sheet molds from which sample sheets were obtained. Example VII included the latex binder system but no reactive resin was included. Each of the samples was dried and cured, and subsequently, the tensile strength of the samples was measured as well as the percent of elongation at break. Next, each of the samples was immersed in dioctyl phthalate, a typical plasticizer, for 24 hours. The samples were blotted to remove excess plasticizer. Next, the tensile strength was measured again as was the percent elongation at break. The results of these tests are tabulated in the following table.

TABLE

| Example | Original Tensile (lbs) | % Elongation | Tensile After Plasticizer Immersion | % Elongation After Plasticizer Immersion |
|---|---|---|---|---|
| I | 54.7 lbs | 4.8% | 39.0 lbs | 8.1% |
| II | 57.1 | 3.8 | 23.1 | 8.4 |
| III | 56.0 | 5.4 | 38.0 | 6.7 |
| IV | 45.6 | 4.5 | 28.7 | 7.6 |
| V | 38.5 | 4.8 | 15.6 | 4.5 |
| VI | 60.1 | 5.4 | 40.5 | 7.6 |
| VII | 33.5 | 3.8 | 10.0 | 4.1 |

It is interesting to note that the initial tensile strength of Examples I–VI is considerably greater than the control example. The same is true for the tensile strength after the plasticizer immersion. The variations noted between Examples I and VI reflect different quantities of reactive resin included in the binder system, and of course, some small differences will be encountered between different reactive resins. Thus the original tensile strength of Examples I–VI ranges from 13–79% greater than the control sample, while the tensile strength after plasticizer immersion ranges from 56–305% greater than the control example. Similar results are noted for the percent elongation which indicates the greater strength of the sheets utilizing the reactive resin according to this invention.

While this invention has been described, it will be understood that it is capable of further modification, and this application is intended to cover any variations, uses and/or adaptations of the invention following in general, the principle of the invention and including such departures from the present disclosure as come within known or customary practice in the art to which the invention pertains, and as may be applied to the essential features hereinbefore set forth, as fall within the scope of the invention or the limits of the appended claims.

What is claimed is:

1. A surface covering material comprising:

a. a layer of felted asbestos fibers, b. about 22 to 37% by weight of said asbestos fiber layer of a resinous binder impregnating said felted asbestos fiber layer, c. a plasticized resinous wear layer applied to said felted asbestos fiber layer and formed of synthetic resins selected from the group consisting of polymerized vinyl halide resins, polymerized vinyl acetates, polymerized acrylic acid, polymerized alkyl esters of acrylic acid, and polymerized alkyl esters of methacrylic acid, and d. said resinous binder consisting essentially of a mixture of a synthetic rubber and about 2% to about 20% by dry weight of said felted asbestos fibers layer of a reactive resin selected from the group consisting of hexamethoxymethylmelamine; 1-hydroxymethyl-3,5-dimethoxymethylmelamine; N,N-dimethylol urea; dihydroxymethylolethylene urea; N,N-bis(methoxymethyl) urea; N,N'dimethylolpropylene urea; 5,5-dimethyl-N,N'-dimethylolpropylene urea; and N,N'-dimethylolethylene urea; and e. whereby said reactive resin improves the dimensional stability of said asbestos fiber layer and reduces softening of said asbestos fiber layer in the presence of said plasticizer.

2. A surface covering as in claim 1 and wherein:

a. said synthetic rubber latex is a butadienestyrene latex.

3. A surface covering as in claim 1 and wherein:

a. said asbestos fibers are crysotile asbestos fibers.

4. A surface covering as in claim 1 and wherein:

a. said reactive resin is hexamethoxymethyl-melamine.

5. A surface covering as in claim 1 and wherein:

a. said reactive resin is 1-hydroxymethyl-3,5-dimethyoxymethylmelamine.

6. A surface covering as in claim 1 and wherein:

a. said reactive resin is N,N'-dimethylol urea.

7. A surface covering as in claim 1 and wherein:

a. said reactive resin is dihydroxymethylol-ethylene urea.

8. A surface covering as in claim 1 and wherein:

a. said reactive resin is N,N'-bis(methoxymethyl) urea.

9. A surface covering as in claim 1 and wherein:

a. said reactive resin is N,N'-dimethylol-propylene urea.

10. A surface covering as in claim 1 and wherein:

a. said reactive resin is 5,5-dimethyl-N,N'-dimethylolpropylene urea.

11. A surface covering as in claim 1 and wherein:

a. said reactive resin is N,N'-dimethylol-ethylene urea.

12. A surface covering as in claim 1 and wherein:

a. said reactive resin is methylated methylolmelamine.

13. A surface covering as in claim 1 and wherein:

a. said resinous binder includes a plasticizer for said reactive resin.

* * * * *